US007305749B2

(12) United States Patent
Kramer

(10) Patent No.: US 7,305,749 B2
(45) Date of Patent: Dec. 11, 2007

(54) WIRE TERMINAL CRIMPER

(76) Inventor: James M. Kramer, 5363 S. Ruth, Ruth, MI (US) 48470

( * ) Notice: Subject to any disclaimer, the term of this patent is extended or adjusted under 35 U.S.C. 154(b) by 363 days.

(21) Appl. No.: 10/911,043

(22) Filed: Aug. 4, 2004

(65) Prior Publication Data

US 2006/0026824 A1 Feb. 9, 2006

(51) Int. Cl.
*H01R 43/042* (2006.01)

(52) U.S. Cl. ..... 29/564.4; 29/566.4; 29/751; 72/409.14; 81/9.51

(58) Field of Classification Search ..... 29/564.4, 29/33 M, 751, 753, 566.4, 761; 72/409.06, 72/416, 409.14
See application file for complete search history.

(56) References Cited

U.S. PATENT DOCUMENTS 3,686,915 A * 8/1972 Miller et al. ..... 29/243.519
3,940,838 A * 3/1976 Gryctko ..... 29/751
4,385,515 A * 5/1983 Link et al. ..... 72/416
6,415,499 B1 * 7/2002 Holland et al. ..... 29/564.4

* cited by examiner

*Primary Examiner*—Richard Chang
(74) *Attorney, Agent, or Firm*—Gregory T. Zalecki

(57) ABSTRACT

A wire terminal crimper is comprised of a frame, a crimping bolt, an anvil, a detent pin and a wire guide. The frame has an anvil bore, a threaded bolt opening and a detent pin opening. The bolt is screwed into the bolt opening. In use, the bolt is tightened upon a wire terminal to crimp the terminal to a wire. The anvil fits within the anvil bore and contains wire terminal seats for holding a terminal in place during crimping. The anvil has a channel containing detent notches for aligning the wire terminal seat with the bolt. The detent pin projects within the anvil channel to align the wire terminal seat with the bolt and to secure the anvil within the frame. The wire guide is comprised of a wire support and the clamp. It maintains the position of the wire terminal and wire during the crimping process.

16 Claims, 5 Drawing Sheets

WIRE TERMINAL CRIMPER

BACKGROUND

Many electrical applications require a wire terminal to be crimped onto a wire. These applications include crimping a terminal onto a wire which is a part of a motor vehicle starting system. A wire terminal typically has a connector at one end and a barrel at the other. The connector facilitates attaching the terminal to an electrical component. The barrel is usually cylindrical in shape and is designed to receive an electrical wire. Most electrical terminals are fabricated from a malleable metal such as copper or brass. In order to attach the wire to the terminal the wire is inserted into the barrel of the terminal. The barrel is then crimped with a tool which compresses the barrel and causes the wire to be securely attached to it.

Motor vehicle mechanics often need to replace the wire terminal attached to a battery cable. Because of the proximity of such battery cable terminals to battery acid it is common for the terminals to become corroded. It then becomes desirable to change the battery cable terminal in order to provide a better electrical connection. This is done by removing the existing wire terminal from the cable and crimping a new terminal onto the cable.

Several tools currently facilitate the crimping of a wire terminal onto a wire. One is a hammer style crimping tool. This tool consists of a frame and a pin. The frame has a seat for receiving the barrel of a wire terminal which has a wire inserted into it. The pin is raised and the wire terminal and wire are placed into the seat. The pin is then hammered in order to crimp the barrel of the terminal onto the wire. The hammer style crimper requires sufficient operating room within which to swing the hammer and a solid working surface to perform the crimping process. This need for space and solid support often requires that the wire or cable assembly be removed from its existing installation to perform this repair. For example, a battery cable may need to be removed from a motor vehicle in order to crimp a new wire terminal onto it. The hammer style crimper often requires two persons to be involved in the crimping process. One holds and guides the wire and terminal while the other hammers the pin of the tool.

A second type of crimping tool is a lever style crimping tool. The lever style crimping tool has a set of jaws, a fulcrum and a set of levers. It has an appearance similar to the appearance of a bolt cutter. However, the jaws are adapted to crimp a wire terminal rather than to cut it. In order to crimp a terminal onto a wire one end of the wire is inserted into the barrel of a wire terminal. The wire terminal and wire are then placed into the jaws of the crimper. The levers are used to cause the jaws to apply a compressive force to the barrel of the terminal and thereby crimp the barrel onto the wire. There also exists a bench mounted version of the lever style crimping tool. The bench mounted version has only one lever but operates on the same principles as the two lever crimping tool. The lever style crimping tool suffers from some of the same drawbacks as the hammer style crimping tool. The space needed to operate it often requires that the wire or cable assembly be removed from the workpiece to which it is attached. Two persons are often required to crimp a wire terminal onto a wire. One person holds and guides the wire and terminal, while the other compresses the levers. An additional drawback of the lever style crimping tool is its cost of manufacture. It has multiple moving parts which must be synchronized with each other. This results in a relatively high design and manufacturing cost.

There is a need for an improved wire crimping tool having the following qualities. It would be compact and easy to manufacture. It could be operated by one person. It could be used in confined areas such as under the hood of a motor vehicle and under a motor vehicle. It would facilitate the replacement of a wire terminal without the wire being removed from its pre-existing environment and connection. It would retain the wire and terminal in place while the tool is being operated. It could be used to crimp wire terminals having a variety of barrel sizes.

SUMMARY

The wire terminal crimper described herein satisfies these needs.

The simplest version of the wire terminal crimper is comprised of a frame and a crimping bolt. The frame has a wire terminal seat. The seat is sized and shaped to receive the barrel of a wire terminal. The frame also has a threaded bolt opening. The longitudinal axis of the threaded bolt opening passes through the wire terminal seat. A crimping bolt is screwed into the bolt opening of the frame. The crimping bolt is directed toward the wire terminal seat. The crimping bolt has a crimping head for crimping the barrel of a wire terminal onto a wire. The crimping head of the crimping bolt is tapered, rather than having a blunt end, in order to facilitate the crimping of a wire terminal barrel onto a wire. Preferably, the crimping head of the crimping bolt is conical. This facilitates the crimping of variable sized barrels of wire terminals. The preferred crimping head of the crimping bolt also has a protruding tip. The protruding tip facilitates the crimping of the barrel of a wire terminal when the barrel has a diameter substantially less than the diameter of the crimping bolt.

Optionally, a wire guide may be mounted to the frame. The wire guide is comprised of a wire support and a clamp. The wire support is sized, shaped and positioned on the frame to support a wire within the wire terminal seat. The clamp is attached to the combined wire terminal crimper and wire support. The clamp is adapted to retain a wire within the guide and within the wire terminal seat thereby facilitating the process of crimping a wire terminal onto a wire by one person.

Preferably, the wire terminal seat is located within an anvil and the anvil is slidingly fit within the frame of the wire terminal crimper. In order to accomplish this the frame has an anvil bore and an anvil seat for receiving the anvil. The anvil slides through the anvil bore and rests upon the anvil seat. The threaded bolt opening of the frame is substantially perpendicular to the longitudinal axis of the anvil bore. The anvil has a wire terminal seat shaped and sized to receive the barrel of a wire terminal. During operation of the wire terminal crimper the barrel of the wire terminal is placed within this wire terminal seat. The anvil may have a plurality of wire terminal seats of various sizes for receiving wire terminal barrels of various sizes. The wire terminal seat is positioned on the side of the anvil which is proximal to the crimping bolt.

Optionally, a spring-loaded detent pin is used to prevent anvil rotation during operation and to ensure that the anvil is retained within the frame. In this configuration the frame has a detent pin opening for receiving a detent pin. The detent pin opening extends into the anvil seat. The anvil has a channel for receiving the detent pin. The anvil channel is on the side of the anvil which is opposite to the side on which the terminal seat is located. A spring-loaded detent pin is secured within the detent pin opening of the frame. The detent pin projects into the channel of the anvil thereby preventing anvil rotation and retaining the anvil within the frame.

Preferably, the anvil has a plurality of variable sized wire terminal seats, as described above, and detent notches. A detent notch is positioned within the anvil channel under the bottom of each seat. Each detent notch is positioned such that it will align the bottom of an associated wire terminal seat with the longitudinal axis of the crimping bolt when the detent pin is forced by the spring load into the detent notch.

DRAWINGS

These and other features, aspects, and advantages of the present invention will become better understood with regard to the following description, appended claims, and accompanying drawings where:

Figure 1:
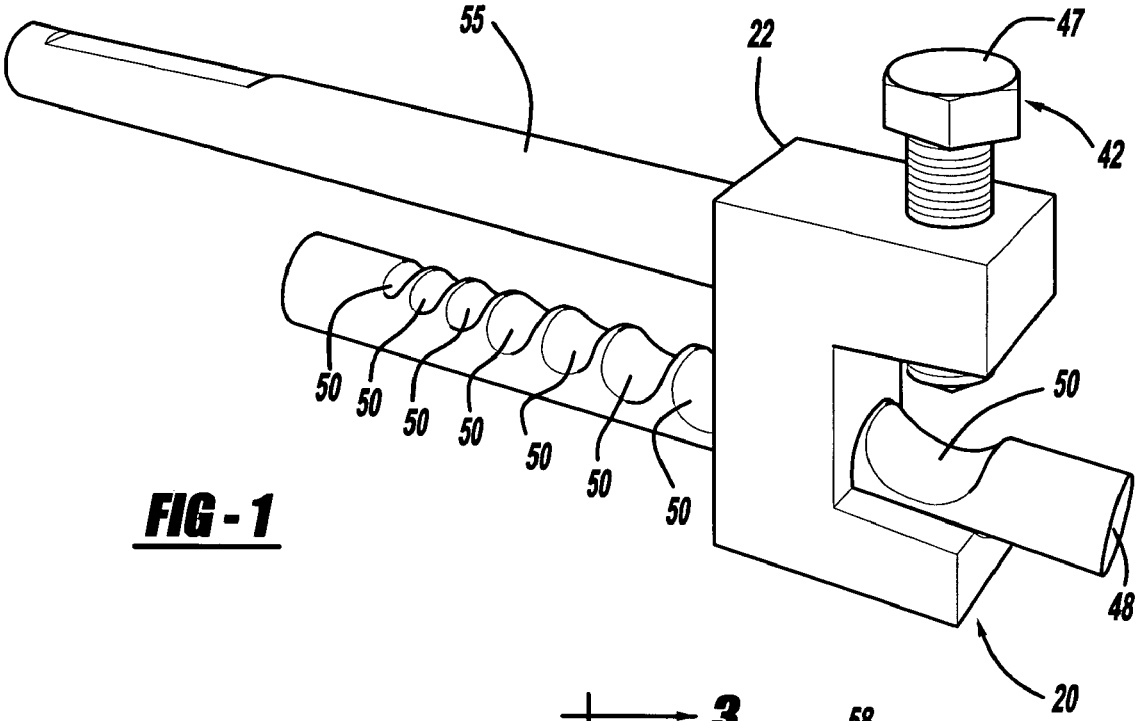
FIG. 1 is a perspective view of a wire terminal crimper.
Figure 2:
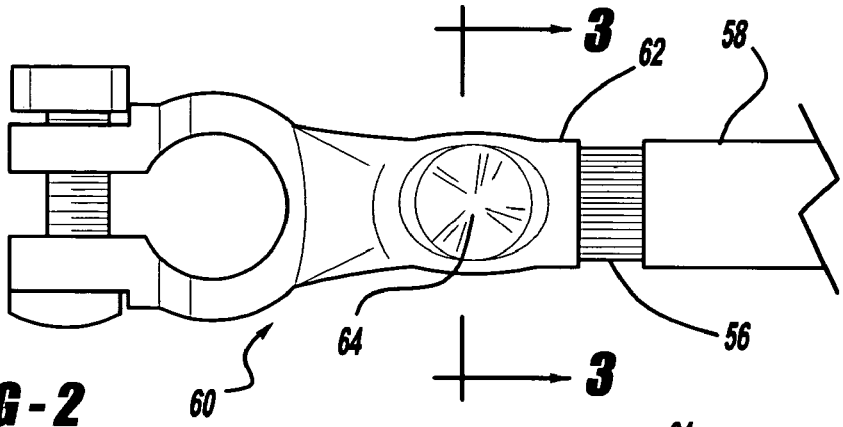
FIG. 2 is a top plan view of a wire terminal crimped onto a wire with the wire terminal crimper of FIG. 1.
Figures 4, 4A:
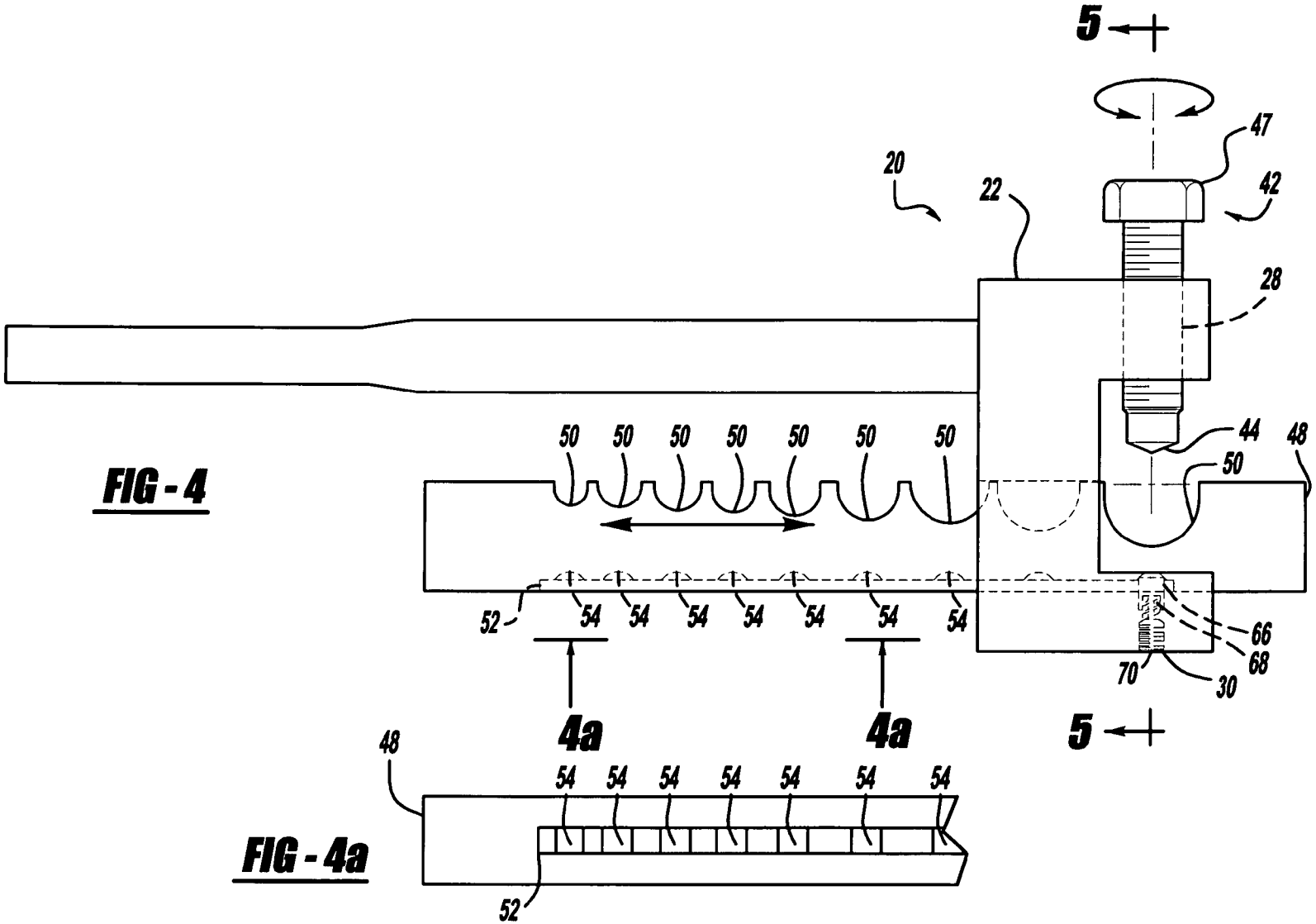
FIG. 4 is a side elevation view of the wire terminal crimper of FIG. 1.

FIG. 4*a* is a bottom plan view of the anvil of the wire terminal crimper of FIG. 1.

Figure 5:
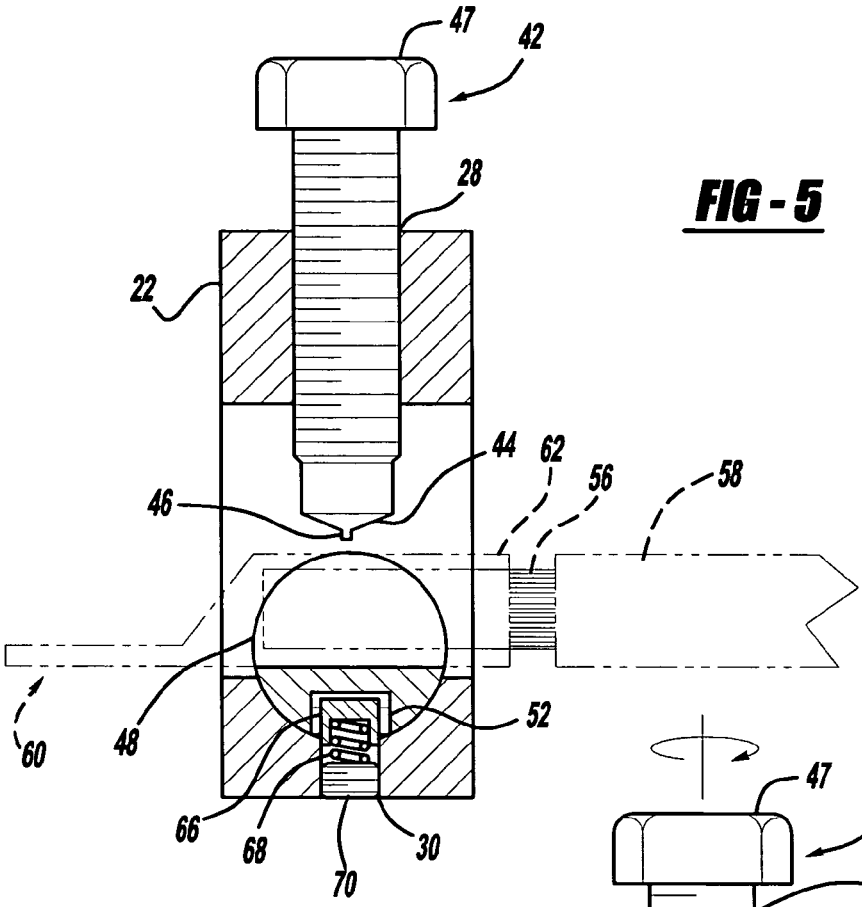

FIG. 5 is a front elevation sectional view of the wire terminal crimper of FIG. 1, showing a wire terminal and a wire positioned within the anvil of the crimper prior to crimping and also showing a crimping bolt with a protruding tip.

Figure 6:
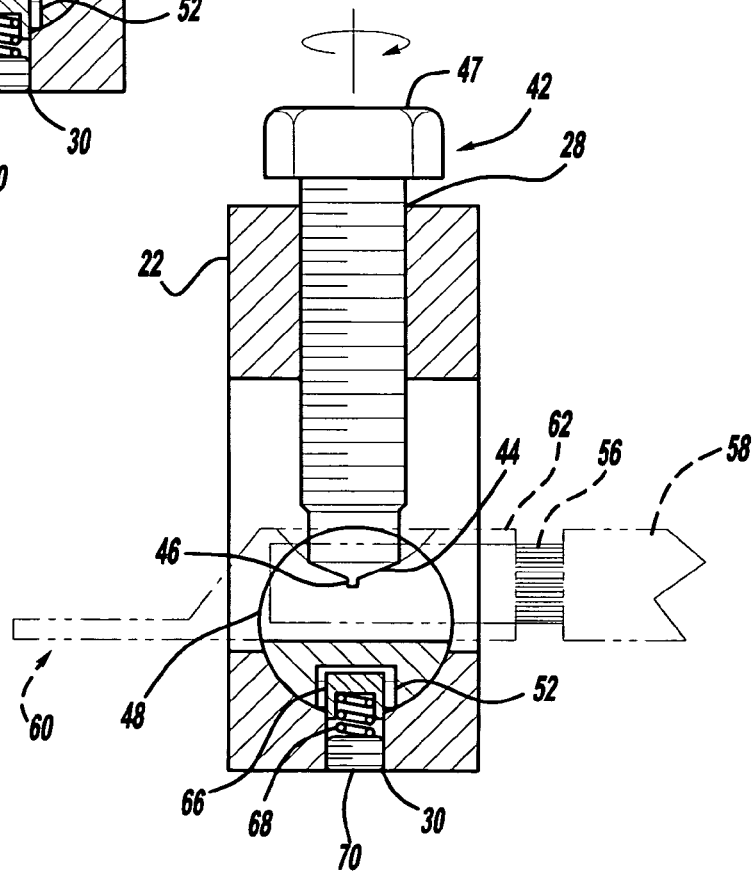

FIG. 6 is a front elevation sectional view of the wire terminal crimper of FIG. 1, showing a wire terminal and a wire positioned within the anvil of the crimper during the crimping process and also showing a crimping bolt with a protruding tip.

Figure 7:
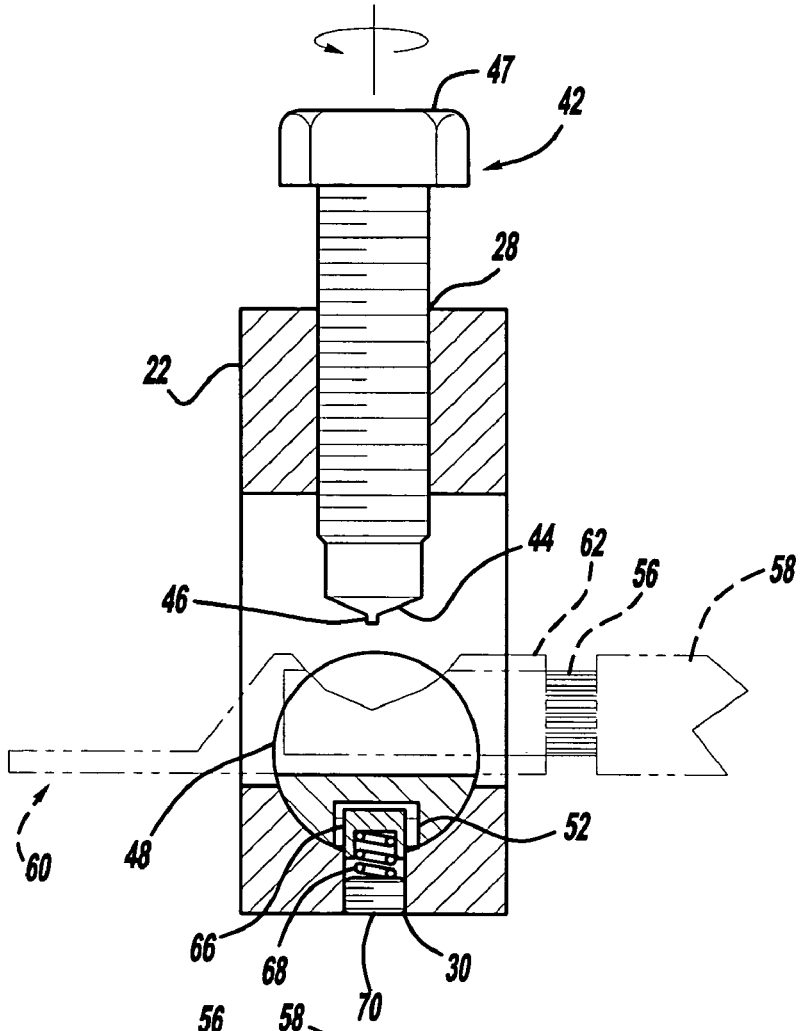

FIG. 7 is a front elevation sectional view of the wire terminal crimper of FIG. 1, showing a wire terminal and a wire positioned within the anvil of the crimper after undergoing the crimping process and also showing a crimping bolt with a protruding tip.

Figure 8:
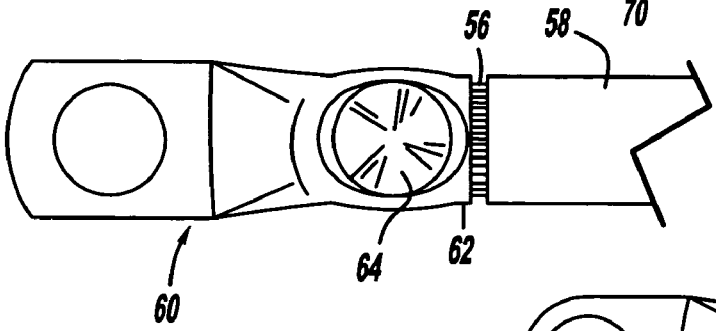

FIG. 8 is a top plan view of a wire terminal crimped onto a wire with the wire terminal crimper of FIG. 1.

Figure 9:
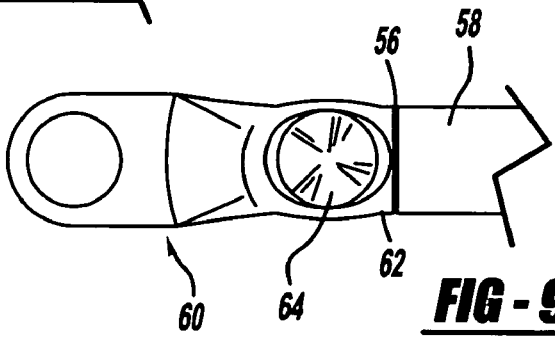

FIG. 9 is a top plan view of a wire terminal crimped onto a wire with the wire terminal crimper of FIG. 1.

Figure 10:
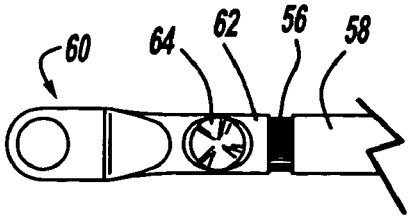

FIG. 10 is a top plan view of a wire terminal crimped onto a wire with the wire terminal crimper of FIG. 1.

Figure 11:
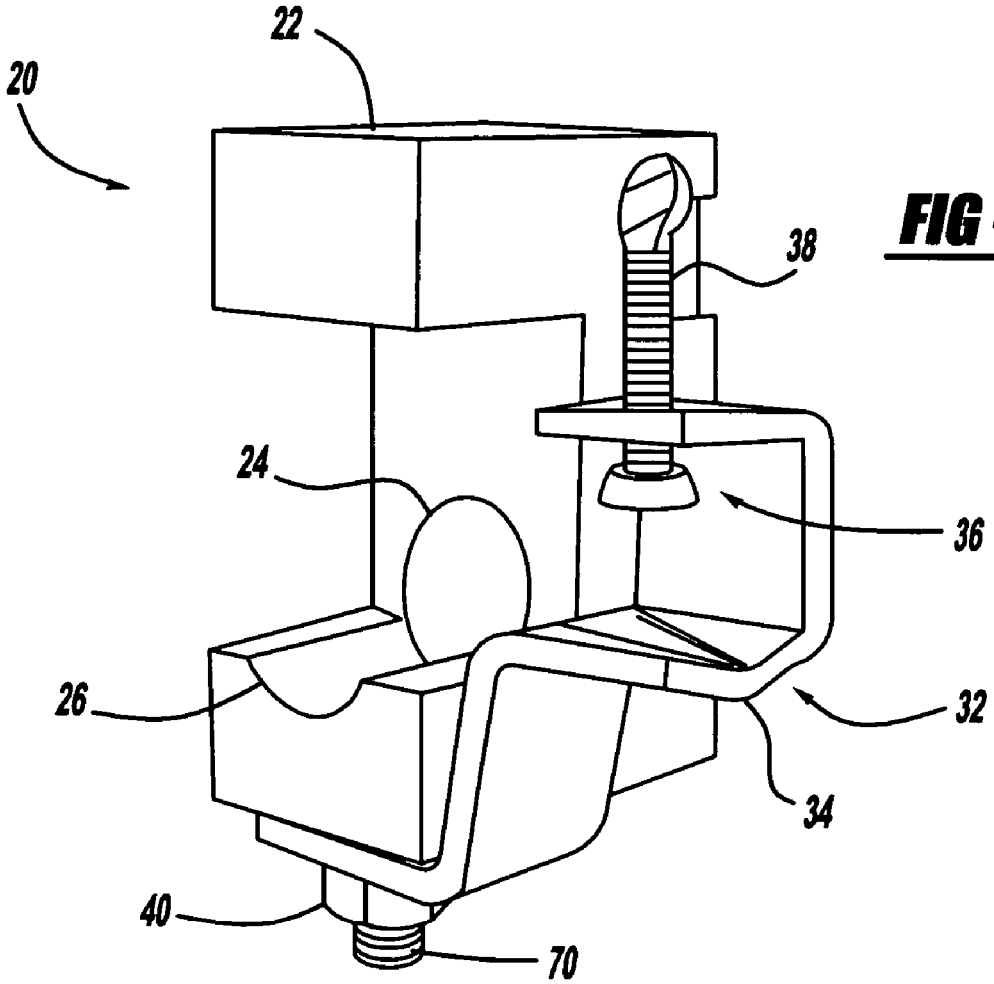

FIG. 11 is a perspective view of a wire terminal crimper which has a wire guide mounted to its frame.

DESCRIPTION

The preferred embodiment of the wire terminal crimper 20 and wire terminal barrel crimps 64 produced by the wire terminal crimper 20 are shown in FIG. 1 through FIG. 11. The wire crimper 20 is comprised of a frame 22, a crimping bolt 42, an anvil 48, a handle 55, a spring-loaded detent pin 66 and a wire guide 32. An object of the wire terminal crimper 20 is to produce a barrel crimp 64 on the barrel 62 of a wire terminal 60. The barrel crimp 64 securely retains a bare wire 56, which has been separated from its insulation 58, within the barrel 62 of the wire terminal 60, as shown and FIG. 2, FIG. 3, FIG. 8, FIG. 9 and FIG. 10.

The preferred material for fabricating the frame 22, the crimping bolt 42, the anvil 48 and the handle 55 is steel. The frame 22 has an anvil bore 24, an anvil seat 26, a threaded bolt opening 28 and a detent pin opening 30. The anvil bore 24 is a round opening sized to permit the anvil 48 to slidingly fit within it, as shown in FIG. 11 and FIG. 1. The anvil seat 26 is a slot within the frame 22 which provides a base upon which the anvil 48 may rest and may be slid, as shown in FIG. 11. The longitudinal axis of the threaded bolt opening 28 is substantially perpendicular to the longitudinal axis of the anvil bore 24. The threaded bolt opening 28 receives the crimping bolt 42. The detent pin opening 30 of the frame 22 extends into the anvil seat 26, as shown in FIG. 4 and FIG. 5. The detent pin opening 30 is sized to receive a detent pin 66, a spring 68 and a set screw 70. The detent pin opening 30 is threaded to receive the set screw 70.

Figure 3:
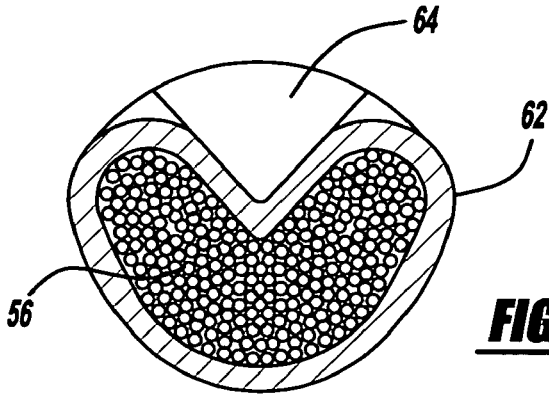
FIG. 3 is a sectional view of the crimped wire and terminal of FIG. 2.

The crimping bolt 42 has a crimping head 44 and a protruding tip 46 at one end. The crimping bolt 42 has a common hex head 47 at its other end. The crimping head 44 of the crimping bolt 42 forms a tapered end, rather than a blunt end, to facilitate the formation of a barrel crimp 64 on the barrel 62 of a wire terminal 60, as shown in FIG. 3. The protruding tip 46 of the crimping bolt 42 is optional, but preferred. The protruding tip 46 facilitates the crimping of the barrel 62 of a wire terminal 60 which has a diameter substantially less than the diameter of the crimping bolt 42. For example, the wire terminal 60 shown in FIG. 10 may be crimped by the wire terminal crimper 20 shown in FIG. 7 even though the diameter of the crimping bolt 42 is much larger than the diameter of the barrel 62 of the wire terminal 60. Preferably, the crimping head 44 of the crimping bolt 42 is conical, as shown in FIG. 4. This facilitates the crimping of variable sized barrels 62 of wire terminals 60 with a single crimping bolt 42. The crimping bolt 42 is screwed into the threaded bolt opening 28 of the frame 22. The crimping bolt 42 is directed toward the anvil seat 26. During the operation of the wire terminal crimper 20 the crimping bolt 42 is tightened so that the crimping head 44 creates a barrel crimp 64 within the barrel 62 of a wire terminal 60.

The anvil 48 is sized and shaped to slidingly fit within the anvil bore 24 and is positioned within the anvil seat 26, as shown in FIG. 1. The anvil 48 has one or more wire terminal seats 50. Preferably, the anvil 48 has a plurality of variable sized wire terminal seats 50. Each wire terminal seat 50 is shaped and sized to receive the barrel 62 of a wire terminal 60, as shown in FIG. 4. As can be seen in FIG. 4, each wire terminal seat 50 has a linear depth dimension and a linear opening dimension. The depth of each wire terminal seat 50 should be greater than one-half of the length of the opening. This will inhibit the barrel 62 of the wire terminal 60 from squeezing out of the wire terminal seat 50 during the crimping process, resulting in a less effective crimp. The wire terminal seats 50 are positioned on the side of the anvil 48 which is proximal to the crimping bolt 42, as shown in FIG. 4.

The other side of the anvil 48 has a channel 52 which is substantially parallel to the longitudinal axis of the anvil 48. The channel 52 is sized and shaped to receive the detent pin 66 such that the interaction between the detent pin 66 and the channel 52 will prevent the anvil 48 from rotating and will retain the anvil 48 within the frame 22. The channel 52 of the anvil 48 also has a detent notch 54 under the bottom of each wire terminal seat 50. Each detent notch 54 is aligned with the bottom of its associated wire terminal seat 50 such that when the spring-loaded detent pin 66 fits within the detent notch 54 the bottom of the wire terminal seat 50 is aligned with the longitudinal axis of the crimping bolt 42, as shown in FIG. 4.

A simple version of a wire terminal crimper 20 can be fabricated without an anvil 48. It would have one wire terminal seat 50 shaped and sized to receive the barrel 62 of a wire terminal 60. That wire terminal seat 50 would be fabricated into the frame 22. The longitudinal axis of the threaded bolt opening 28 would pass through the wire terminal seat 50.

The detent pin 66 is placed over the spring 68 and positioned within the detent pin opening 30 of the frame 22. The detent pin 66 and spring 68 are held in place by the set screw 70. The set screw 70 may be tightened or loosened to increase or decrease the degree of spring loading upon the detent pin 66. The detent pin 66 projects into and closely fits within the channel 52 of the anvil 48 such that it prevents the anvil 48 from rotating and prevents the anvil 48 from falling out of the frame 22. The spring loading of the detent pin 66 will cause a wire terminal seat 50 of the anvil to be properly aligned with the longitudinal axis of the crimping bolt 42 when the detent pin 66 is forced by the spring 68 into the detent notch 54 of the wire terminal seat 50 associated with that detent notch 54.

Optionally and preferably, a wire guide 32 is mounted to the frame 22. The wire guide 32 is comprised of a wire support 34 and a clamp 36. The wire support 34 is sized, shaped and positioned on the frame 22 such that it will support a wire within a selected wire terminal seat 50. The clamp 36 is attached to the combined wire terminal crimper 20 and wire support 34. The clamp 36 is adapted to retain a wire 56 within the guide 32 and within the wire terminal seat 50. The clamp 36 may be a thumbscrew having a blunt end 38 screwed into a threaded opening of the wire support 34, as shown in FIG. 11. Common spring-loaded types of clamps may also be used.

FIG. 11 shows an elongated set screw 70. Such a set screw 70 performs a dual function. It retains the detent pin 66 and the spring 68 within the detent pin opening 30 of the frame 22. It also provides a threaded stud upon which the wire guide 32 may be removably mounted. In this configuration the wire support 34 has a mounting hole for mounting to the frame 22 of the wire terminal crimper 20. The wire guide 32 is mounted to the frame 22 by positioning the elongated set screw 70 through the mounting hole of the wire support 34 and securing the wire support 34 to the frame 22 with a set screw nut 40, as shown in FIG. 11. When the wire guide 32 is attached to the frame 22, a wire 56 may be easily secured within a selected wire terminal seat 50 by tightening the clamp 36. When the clamp 36 is a thumbscrew 38, the clamp 36 is tightened by turning the thumbscrew 38. The wire guide 32 allows the barrel 62 of a wire terminal 60 containing a wire 56 to be held in position by one person who is performing the crimping process when, otherwise, a second person would be required to guide and hold the wire terminal 60 and wire 56. If compactness is more important than having a wire guide 32 for a given application, the wire guide 32 may be easily removed from the frame 22 by loosening and removing the set screw nut 40 and wire guide 32.

The preferred embodiment of the wire terminal crimper 20 includes a removable handle 55. The handle 55 may have a threaded stud axially protruding from one end which fits into a corresponding threaded hole within the frame 22. Some crimping processes requiring a high torque to be applied to the crimping bolt 42 may be easier to perform with the handle 55 mounted to the frame 22. Other crimping processes may be easier to perform with the handle 55 removed from the frame 22 in order to provide a more compact wire terminal crimper 20. The removability of the handle 55 allows the user to easily use the wire terminal crimper 20 in either configuration—with or without the handle 55.

The procedure for crimping the barrel 62 of a wire terminal 60 onto a wire 56 is simple. First, the wire 56 is prepared. If necessary, a pre-existing wire terminal 60 is removed from the wire 56. Sufficient insulation 58 is removed to allow bare wire 56 to be inserted into the barrel 62 of a new wire terminal 60. A wire terminal seat 50 on the anvil 48 is selected which fits the barrel 62 of the new wire terminal 60. The anvil 48 is slid through the anvil bore 24 until the desired wire terminal seat 50 is aligned with the longitudinal axis of the crimping bolt 42. The spring-loaded detent pin 66 causes a sufficient degree of force to be required to slide the anvil 48. When the anvil 48 is slid into its proper position causing the bottom of the desired wire terminal seat 50 to be in alignment with the longitudinal axis of the crimping bolt 42, the detent pin 66 will project into the detent notch 54 associated with the wire terminal seat 50 and hold the wire terminal seat 50 in its proper alignment with the longitudinal axis of the crimping bolt 42. The crimping bolt 42 is unscrewed a sufficient amount to permit the new wire terminal 60 to be inserted into the desired wire terminal seat 50. The clamp 36 of the wire guide 32 is opened to receive the wire 56 which is intended to be worked upon. If the clamp 36 is a thumbscrew clamp 38 as shown in FIG. 11, the thumbscrew 38 is opened. The new wire terminal 60 having the wire 56 inserted into its barrel 62 is placed into the selected wire terminal seat 50 of the anvil 48 such that the barrel 62 rests within the wire terminal seat 50. The wire guide 32 clamp 36 is closed to hold the wire 56 and wire terminal 60 in place. The removable handle 55 may be left in place for high torque applications or removed where conservation of workspace is critical. The crimping bolt 42 is hand tightened until the crimping head 44 of the crimping bolt 42 meets the barrel 62 of the new wire terminal 60. A common wrench, such as a box wrench, an open-end wrench or a crescent wrench, is used to tighten the crimping bolt 42 at its hex head 47. The crimping bolt 42 is tightened until the desired barrel crimp 64 is created upon the barrel 62 of the new wire terminal 60. Once the desired the barrel crimp 64 is created the wire terminal crimper is removed after loosening the crimping bolt 42 and the clamp 36.

The wire terminal crimper has numerous advantages. It is relatively simple to manufacture. It requires less room to operate than a hammer style crimper or a lever style crimper. It can be used in confined areas such as under the hood of a motor vehicle and under a motor vehicle. Much labor and time is saved when a new wire terminal 60 can be installed upon an electrical cable of a motor vehicle without the necessity of the cable being removed from the vehicle. There is often insufficient space and an inadequate work surface within the work area to swing a hammer upon the pin of a hammer style crimper or to actuate the levers of a lever style crimper. Most uses of the wire terminal crimper 20 require only one person to perform the desired task. This is to be contrasted to many tasks involving the hammer style crimper and the lever style crimper which require two persons to complete the task. The wire guide 32 of the wire crimper 20 will often obviate the need for a second person to hold and guide the wire 56 while it is being crimped because the wire guide 32 holds the wire 56 and wire terminal 60 in position during the crimping process. If terminal crimp repeatability and reproducibility is required, a torque wrench can be used to assure a controlled crimping process. This is not achievable with the hammer style or a standard lever style crimping tool. An additional advantage of the wire terminal crimper 20 is that it can be used on wire terminals 60 having a wide variety of barrel 62 diameters because the anvil 48 has a plurality of various sized wire terminal seats 50 sized and shaped to receive various sized barrels 62. The wire terminal crimper 20 can be used on electrical systems for most engine powered equipment including farm equipment, off-road vehicles, light-duty cars and trucks, construction equipment, generators, heavy-duty trucks and buses, marine equipment and transfer and sludge pumps. However, it is not limited to use on engine powered equipment.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A wire terminal crimper comprising:

(a) a frame having (i) a wire terminal seat radially shaped and sized to receive the barrel of a battery wire terminal, and (ii) a threaded bolt opening for receiving a crimping bolt, the longitudinal axis of said threaded bolt opening passing through the wire terminal seat;

(b) a crimping bolt screwed into the bolt opening of the frame and directed toward the seat, said bolt comprising a threaded rod having a bolt head at one end and a conical crimping head at its other end for crimping the barrel of a wire terminal onto a wire; and a removable handle attached to the frame and wherein the bolt head is a common head.

2. The wire terminal crimper of claim 1, further comprising a wire guide mounted to the frame, said wire guide comprising:

(a) a wire support sized, shaped and positioned on the frame to support a wire within the wire terminal seat; and (b) a clamp attached to the combined wire terminal crimper and wire support, said clamp being adapted to retain a wire within the guide and within the wire terminal seat.

3. The wire terminal crimper of claim 1, wherein the crimping head of the crimping bolt has a protruding tip for crimping the barrel of a wire terminal which has a diameter substantially less than the diameter of the crimping bolt.

4. The wire terminal crimper of claim 2, wherein the crimping head of the crimping bolt has a protruding tip for crimping the barrel of a wire terminal which has a diameter substantially less than the diameter of the crimping bolt.

5. A wire terminal crimper comprising:

(a) a frame having (i) an anvil bore and an anvil seat for receiving an anvil, and (ii) a threaded bolt opening substantially perpendicular to the longitudinal axis of the anvil bore for receiving a crimping bolt;

(b) a crimping bolt screwed into the bolt opening of the frame and directed toward the anvil seat, said bolt comprising a threaded rod having a bolt head at one end and a conical crimping head at its other end for crimping the barrel of a wire terminal onto a wire;

(c) an anvil slidingly fit within the anvil bore and positioned within the anvil seat, said anvil having a wire terminal seat radially shaped and sized to receive the barrel of a wire terminal for receiving the barrel of a wire terminal, said wire terminal seat being on the side of the anvil proximal to the crimping wire; and a removable handle attached to the frame and wherein the bolt head is a common head.

6. The wire terminal crimper of claim 5, further comprising a wire guide mounted to the frame, said wire guide comprising:

(a) a wire support sized, shaped and positioned on the frame to support a wire within the wire terminal seat; and (b) a clamp attached to the combined wire terminal crimper and wire support, said clamp being adapted to retain a wire within the guide and within the wire terminal seat.

7. The wire terminal crimper of claim 5, wherein the crimping head of the crimping bolt has a protruding tip for crimping the barrel of a wire terminal which has a diameter substantially less than the diameter of the crimping bolt.

8. The wire terminal crimper of claim 6, wherein the crimping head of the crimping bolt has a protruding tip for crimping the barrel of a wire terminal which has a diameter substantially less than the diameter of the crimping bolt.

9. A wire terminal crimper comprising:

(a) a frame having (i) an anvil bore and an anvil seat for receiving an anvil, (ii) a threaded bolt opening substantially perpendicular to the longitudinal axis of the anvil bore for receiving a crimping bolt, and (iii) a detent pin opening extending into the anvil seat for receiving a detent pin;

(b) a crimping bolt screwed into the bolt opening of the frame and directed toward the anvil seat, said bolt comprising a threaded rod having a bolt head at one end and a conical crimping head at its other end for crimping the barrel of a wire terminal onto a wire;

(c) an anvil slidingly fit within the anvil bore and positioned within the anvil seat, said anvil having a wire terminal seat radially shaped and sized to receive the barrel of a wire terminal for receiving the barrel of a wire terminal, said wire terminal seat being on the side of the anvil proximal to the crimping bolt, and said anvil having a channel on the other side of the anvil for receiving a detent pin;

(d) a spring-loaded detent pin secured within the detent pin opening of the frame and projecting into the channel of the anvil for preventing anvil rotation and retaining the anvil within the frame; a wire guide mounted to the frame and aligned with one of the wire terminal seats, said wire guide comprising:

(a) a wire supported sized, shaped and positioned on the frame to support a wire within the wire terminal seat; and (b) a clamp atached to the wire terminal crimper and wire support, said clamp being adapted to retain a wire within the guide and within the wire terminal seat.

10. The wire terminal crimper of claim 9, further comprising a removable handle attached to the frame and wherein the bolt head is a common hex head.

11. The wire terminal crimper of claim 9, wherein the crimping head of the crimping bolt has a protruding tip for crimping the barrel of a wire terminal which has a diameter substantially less than the diameter of the crimping bolt.

12. The wire terminal crimper of claim 9, wherein the crimping head of the crimping bolt has a protruding tip for crimping the barrel of a wire terminal which has a diameter substantially less than the diameter of the crimping bolt.

13. A wire terminal crimper comprising:

(a) a frame having (i) an anvil bore and an anvil seat for receiving an anvil, (ii) a threaded bolt opening substantially perpendicular to the longitudinal axis of the anvil bore for receiving a crimping bolt, and (iii) a detent pin opening extending into the anvil seat for receiving a detent pin;

(b) a crimping bolt screwed into the bolt opening of the frame and directed toward the anvil seat, said bolt comprising a threaded rod having a bolt head at one end and a conical crimping head at its other end for crimping the barrel of a wire terminal onto a wire;

(c) an anvil slidingly fit within the anvil bore and positioned within the anvil seat, said anvil having one or more wire terminal seats for receiving the barrel of a wire terminal, each said wire terminal seat being shaped and sized to receive the barrel of a wire terminal, each said wire terminal seat being on the side of the anvil proximal to the crimping bolt and said anvil having a channel on the other side of the anvil for receiving a detent pin, said channel having a detent notch under the bottom of each wire terminal seat for aligning the bottom of the wire terminal seat with the longitudinal axis of the crimping bolt;

(d) a spring-loaded detent pin secured within the detent pin opening of the frame and projecting into the channel of the anvil for preventing anvil rotation, retaining the anvil within the frame and aligning the bottom of a wire terminal seat with the longitudinal axis of the crimping bolt; a wire guide mounted to the frame and aligned with one of the wire terminal seats, said wire guide comprising:

(a) a wire support sized, shaped and positioned on the frame to support a wire within the wire terminal seat; and (b) a clamp attached to the wire terminal crimper and wire support, said clamp being adapted to retain a wire within the guide and within the wire terminal seat.

14. The wire terminal crimper of claim 13, further comprising a removable handle attached to the frame and wherein the bolt head is a common hex head.

15. The wire terminal crimper of claim 13, wherein the crimping head of the crimping bolt has a protruding tip for crimping the barrel of a wire terminal which has a diameter substantially less than the diameter of the crimping bolt.

16. The wire terminal crimper of claim 12, wherein the crimping head of the crimping bolt has a protruding tip for crimping the barrel of a wire terminal which has a diameter substantially less than the diameter of the crimping bolt.

* * * * *